US006296457B1

(12) United States Patent
Shintoku et al.

(10) Patent No.: US 6,296,457 B1
(45) Date of Patent: Oct. 2, 2001

(54) DISCHARGE PULSATION DAMPING APPARATUS FOR COMPRESSOR

(75) Inventors: Noriyuki Shintoku; Hisato Kawamura; Naofumi Kimura; Kazuhiro Tanikawa, all of Kariya (JP)

(73) Assignee: Kabushiki Kaisha Toyoda Jidoshokki, Kariya (JP)

( * ) Notice: Subject to any disclaimer, the term of this patent is extended or adjusted under 35 U.S.C. 154(b) by 0 days.

(21) Appl. No.: 09/543,139

(22) Filed: Apr. 5, 2000

(30) Foreign Application Priority Data

Apr. 15, 1999 (JP) ..... 11-107719

(51) Int. Cl.[7] ..... F04B 39/00; F04B 1/12

(52) U.S. Cl. ..... 417/312; 417/269; 181/403

(58) Field of Search ..... 417/312, 269; 181/403

(56) References Cited

U.S. PATENT DOCUMENTS

| | | | | |
|---|---|---|---|---|
| 4,221,544 | * | 9/1980 | Ohta | 417/269 |
| 4,418,443 | * | 12/1983 | Fischer | 15/326 |
| 4,534,710 | * | 8/1985 | Higuchi et al. | 417/269 |
| 4,960,368 | * | 10/1990 | Lilie | 417/312 |
| 5,046,935 | * | 9/1991 | Iio et al. | 417/312 |
| 5,205,719 | * | 4/1993 | Childs et al. | 417/312 |
| 5,636,974 | * | 6/1997 | Ikeda et al. | 417/269 |
| 5,893,706 | * | 4/1999 | Kawaguchi et al. | 417/373 |
| 5,899,670 | | 5/1999 | Ikeda et al. | 417/312 |

FOREIGN PATENT DOCUMENTS

| | | | | |
|---|---|---|---|---|
| 02-55880 | * | 2/1990 | (JP) | 417/454 |
| A-10-9134 | | 1/1998 | (JP) . | |
| A-10-54358 | | 2/1998 | (JP) . | |
| A-10-89251 | | 4/1998 | (JP) . | |
| A-10-141220 | | 5/1998 | (JP) . | |

* cited by examiner

*Primary Examiner*—Timothy S. Thorpe
*Assistant Examiner*—Timothy P. Solak
(74) *Attorney, Agent, or Firm*—Woodcock Washburn Kurtz Mackiewicz & Norris LLP

(57) ABSTRACT

In a discharge pulsation damping apparatus of a compressor according to this invention, an expansion muffler 46 and a resonance muffler 58 each having a predetermined capacity are defined inside cylinder blocks 11 and 12 through partitions 59 and 60 so that the resonance muffler 58 is situated at a position higher than the expansion muffler 46 in a gravitational direction (vertical direction). The expansion muffler 46is connected to discharge chambers 38 and 39 and to an outlet 48, and both mufflers 46 and 58 are communicated by a communication passage 61 formed in the partitions 59and 60. The capacity of the resonance muffler 58, the open sectional area of the communication passage 61 and its passage length are set to values such that a pressure change capable of offsetting specific frequency components of the discharge pulsation inside the expansion muffler 46 can be generated inside the resonance muffler 58. The lubricant condensed inside the resonance muffler 58 is fed back into the expansion muffler 46 through the communication passage 61.

10 Claims, 4 Drawing Sheets

DISCHARGE PULSATION DAMPING APPARATUS FOR COMPRESSOR

BACKGROUND OF THE INVENTION

1. Field of the Invention

This invention relates to a discharge pulsation damping apparatus for a compressor used in a car air conditioner, a compressed air supply apparatus, and so forth.

2. Description of the Related Art

A compressor of this type has a construction in which a compressive fluid sucked from outside is introduced into an operation chamber and the pressure of this compressive fluid is elevated by reducing the volume of the operation chamber. In such a compressor, the compressive fluid so compressed is discharged from the operation chamber into a discharge chamber within a predetermined time interval. In consequence, a so-called "discharge pulsation" occurs due to the pressure change inside the discharge chamber in accordance with the discharge timing. In a reciprocation type compressor in which a plurality of cylinder bores are bored around a rotary shaft and pistons accommodated in the cylinder bores are caused to reciprocate by a rocking motion of a swash plate that is fitted to the rotary shaft to execute the compression operation, a discharge pulsation, that has various orders (ratio of revolutions to frequency) of frequency components corresponding to the number of the cylinder bores (the number of cylinders) occurs. When such a discharge pulsation takes place, resonance occurs in external piping arrangements connected to the compressor, thereby inviting the problems of vibration and noise.

To reduce the vibration and the noise, conventional compressors are equipped with a discharge pulsation damping apparatus that damps the discharge pulsation occurring due to the compression operation of the compressor. An expansion type discharge muffler is known as a discharge pulsation damping apparatus of this kind. The discharge muffler defines an expansion space having a predetermined capacity inside the housing of a compressor, and supplies a compressive fluid from the discharge chamber to the external piping arrangements through the expansion space.

However, the construction according to the prior art generally needs an expansion space having a sufficient capacity so as to effectively damp the discharge pulsation, and this invites an increase in the size of the compressor. In a compressor that is used as a car air conditioner, the mounting space for the compressor, inside the engine compartment, is limited. Therefore, the conventional expansion type muffler cannot secure a sufficient capacity and cannot sufficiently damp those noise components which have a predetermined frequency range in the discharge pulsation.

This problem could be solved, for example, by connecting a resonance type discharge muffler comprising a resonance space like a dead end having a predetermined capacity on an intermediate portion of a discharge passage that extends from the discharge chamber of the compressor to the external piping arrangement, through a communication passage. In the resonance type discharge muffler, a part of the compressive fluid flowing through the discharge passage is guided into the resonance space through the communication passage. A pressure change that offsets the frequency component in a predetermined frequency range in the discharge pulsation is thus generated.

In order to stably generate the pressure change that offsets the intended frequency component, however, the resonance type muffler must always keep the capacity of its resonance space at a predetermined value. However, the compressive fluid contains a lubricant, water, etc, in order to secure lubricating and cooling functions at sliding portions inside the compressor. Quite naturally, therefore, the lubricant, etc, flows with the compressive fluid into the resonance space. When such a lubricant condenses and stays inside the resonance space, the capacity of the resonance space changes. This change makes the generation of the pressure change unstable and eventually, the intended frequency components cannot be damped sufficiently.

SUMMARY OF THE INVENTION

In order to solve these problems of the prior art technologies, the present invention aims at providing a discharge pulsation damping apparatus of a compressor that can stably offset the intended frequency components of a discharge pulsation within a limited space.

In a compressor including, inside a housing thereof, a compression mechanism so constituted as to suck a compressive fluid from outside and compress it by the operation of the compression mechanism and to discharge the compressive fluid so compressed into a discharge chamber defined in the housing, a flow passage for guiding the compressive fluid in the discharge chamber to the outside of the compressor, and a discharge muffler region defined at an intermediate portion of the flow passage inside the housing, a discharge pulsation damping apparatus according to the present invention for accomplishing the object described above includes a partition inside the discharge muffler region which divides the discharge muffler region into a first muffler chamber constituting a part of the flow passage and a second muffler chamber communicated with the first muffler chamber by a communication passage and independent of the flow passage, and feedback means for feeding back the liquid carried by the compressive fluid, supplied into the second muffler chamber and condensed in the second muffler chamber, to the first muffler chamber.

The liquid condensed inside the second muffler chamber is fed back to the first muffler chamber by the feedback means and does not stay inside the second muffler chamber. Therefore, the capacity of the second muffler chamber can be kept always constant, and a pressure change that offsets the components of the intended frequency range in the discharge pulsation can be generated stably.

The present invention may be more fully understood from the description of a preferred embodiment set forth below, together with the accompanying drawings.

DESCRIPTION OF THE PREFERRED EMBODIMENTS

[First Embodiment]

Hereinafter, the first embodiment of the present invention, which is applied to a discharge pulsation damping apparatus of a double-headed piston swash-plate type compressor of a car air conditioner, will be explained with reference to FIGS. 1 to 4.

Figure 1:
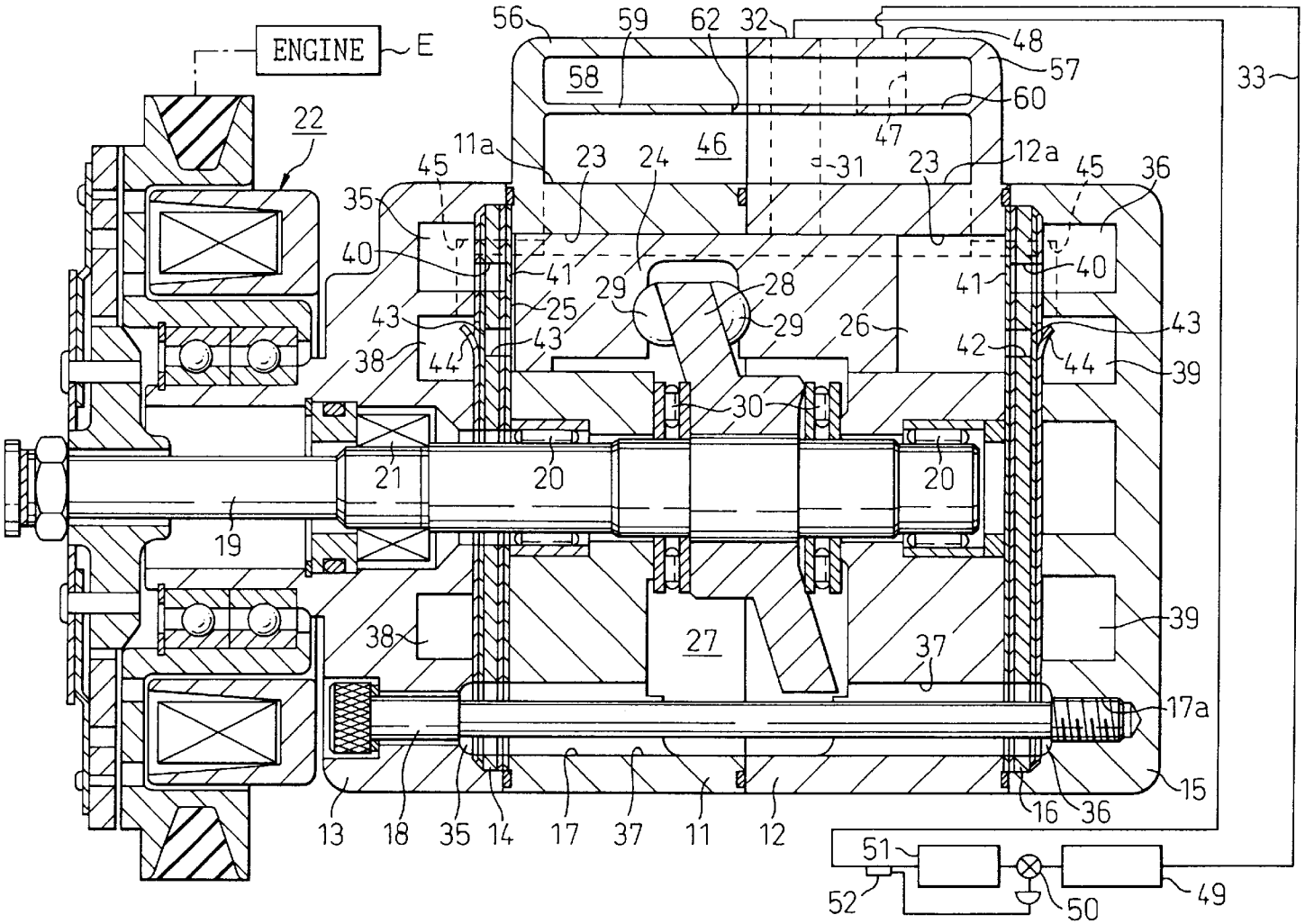
FIG. 1 is a sectional view showing, as a whole, a a compressor according to the first embodiment of the present invention.

A pair of cylinder blocks 11 and 12 as housing constituent members are joined to each other at their opposed end portions as shown in FIG. 1. A front housing 13, that is also a housing constituent member, is joined to the front end face of the cylinder block 11 on the front side through a front side valve forming body 14. A rear housing 15, that is also a housing constituent member, is joined to the rear end face of the rear side cylinder block 12 through a rear side valve forming body 16.

A plurality of bolt insertion holes 17 are formed in such a manner as to penetrate through the front housing 13, the front side valve forming body 14, both cylinder blocks 11 and 12 and the rear side valve forming body 16, and to be bored in the rear housing 15. A plurality of through-bolts 18 are inserted through the bolt insertion holes 17 from the side of the front housing 13, and screwed, at their distal end, into screw holes 17*a* formed in the rear housing 15, respectively. The front housing 13 and the rear housing 15 are fastened and fixed to the end faces of the corresponding cylinder blocks 11 and 12 by these through-bolts 18.

A drive shaft 19 is rotatably supported at the center of the cylinder blocks 11, 12 and the front housing 13 through a pair of front and rear radial bearings 20. A lip seal 21 is interposed between the outer periphery at the front end of the drive shaft 19 and the front housing 13. The drive shaft 19 is connected at its front end to a car engine E forming an external driving source through a clutch mechanism 22. When the clutch mechanism 22 is engaged, the drive shaft 19 is driven for rotation, and the drive force of the car engine E is transmitted thereto.

Figure 2:
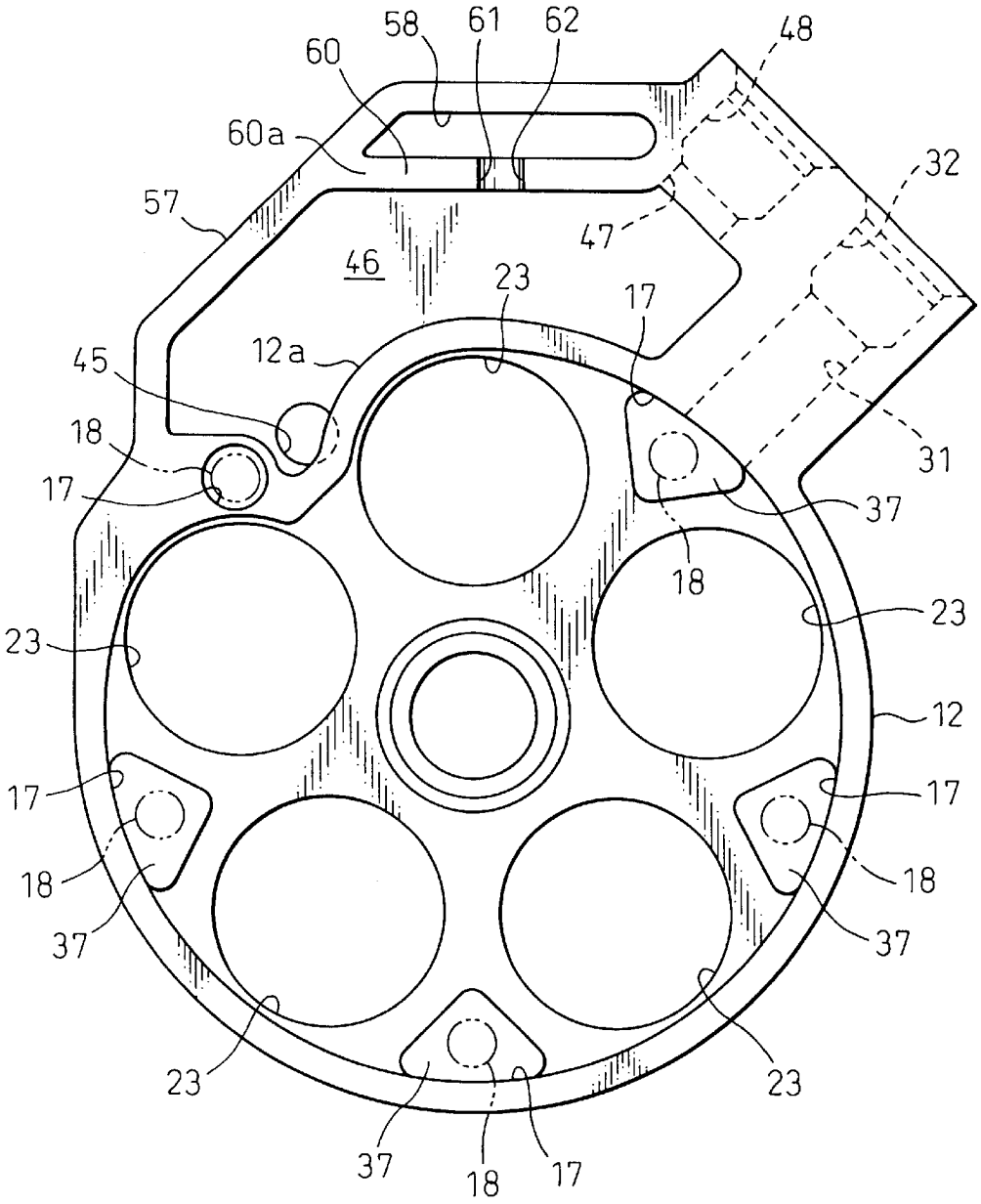
FIG. 2 is a side view of a cylinder block on the rear side in FIG. 1 when it is viewed from the front side.

As shown in FIGS. 1 and 2, a plurality (five, in this embodiment) of cylinder bores 23 are bored equiangularly around the drive shaft 19 through both end portions of each cylinder block 11, 12. Double-headed type pistons 24 that constitute a plurality of compression mechanisms are fitted into, and supported by, the cylinder bores 23 in such a manner as to be capable of reciprocating. A plurality (five, in this embodiment) of operation chambers (front side) and 26 (rear side) are formed in each cylinder bore 23, respectively. In other words, the compressor of this embodiment is a 10-cylinder double-headed piston type compressor.

A crank chamber 27 is defined at an intermediate portion between, and inside, both cylinder blocks 11 and 12. A swash plate 28 is fitted and fixed to the drive shaft 19 inside the crank chamber 27, and its outer peripheral portion is engaged with the intermediate portion of the piston 24 through a pair of shoes 29. The piston 24 is caused to reciprocate through the swash plate 28 by the rotation of the drive shaft 19. A pair of front and rear thrust bearings 30 is interposed between both end faces of the swash plate 28 and the inner end face of each cylinder block 11, 12. The swash plate 28 is clamped and held between both cylinder blocks 11 and 12 through the thrust bearings 30. The crank chamber 27 is connected to an external refrigerant circuit 33 forming an external piping arrangement through an introduction passage 31 and an inlet 32, and constitutes a suction pressure region.

A front side suction chamber 35 and a rear side suction chamber 36 are defined annularly on the outer peripheral side in the front and rear housings 13 and 15, respectively. Suction passages 37 that function also as the bolt insertion holes 17 described above are so formed as to penetrate through both cylinder blocks 11 and 12 and connect the front side suction chamber 35 and the rear side suction chamber 36 to the crank chamber 27, respectively. A front side discharge chamber 38 and a rear side discharge chamber 39 are defined as annularly on the center side in the front and rear housings 13 and 15, respectively.

A plurality of suction ports 40 are formed, in the valve forming bodies 14 and 16, in such a manner as to penetrate through these valve forming bodies and to correspond to the cylinder bores 23, respectively. A suction valve 41 is formed in each valve forming body 14, 16 and opens and closes each suction port 40. The suction valve 41 is opened with the movement of each piston 24 from top dead center to the bottom dead center, and a refrigerant gas is sucked from both suction chambers 35 and 36 into the operation chambers 25 and 26.

A plurality of discharge ports 42 are bored in each valve forming body 14, 16 in such a manner as to penetrate through the valve forming body 14, 16 and to correspond to each cylinder bore 23. A discharge valve 43 is formed in each valve forming body 14, 16 and opens and closes each discharge port 42. The refrigerant gas inside each operation chamber 25, 26 is compressed to a predetermined pressure with the movement of each piston 24 from its lower dead point to its upper dead point. It is then discharged into both discharge chambers 38 and 39 by the operation of the discharge valve 43. Incidentally, opening of the discharge valve 43 is limited by a retainer 44 superposed on each valve forming body 14, 16.

Each discharge chamber 38, 39 is communicated with the external refrigerant circuit 33 described above through a discharge passage 45, an expansion muffler 46 as a first muffler chamber and a communication passage comprising a delivery passage 47 and an outlet 48. The expansion muffler 46 constitutes a part of a discharge muffler region, and is an expansion type muffler having a predetermined capacity.

A condenser 49, an expansion valve 50 and an evaporator 51 are serially connected to the external refrigerant circuit 33. The condenser 49 cools the high-temperature high-pressure refrigerant gas discharged from the compressor and condenses the gas to the liquid refrigerant. The expansion valve 50 plays the role of a variable throttle, expands the high-temperature high-pressure liquid refrigerant and changes it to a low-temperature low-pressure condition (to the atomized state, for example). The evaporator 51 evaporates the atomized liquid refrigerant by heat-exchange with the air supplied into the passenger compartment.

The valve opening of the expansion valve 50 is controlled on the basis of the temperature detected by a thermosensitive cylinder 52 that is juxtaposed with the evaporator 51. In consequence, the flow rate of the refrigerant in the external refrigerant circuit 33 is adjusted so that the evaporation condition of the refrigerant in the evaporator 51 has a suitable degree of heating. The refrigerant gas that is evaporated by the evaporator 51 is fed back again into the crank chamber 27 by the compression operation of the compressor through the inlet 32 and the introduction passage 31, and is used again for compression.

Next, the muffler construction of the double-headed piston type compressor having the construction described above will be explained.

A front side expansion portion 56 is formed integrally with the outside portion of the front side cylinder block 11 as shown in FIGS. 1 and 2. A rear side expansion portion 57 is formed integrally with the outside portion of the rear side cylinder block 12, and is connected to the front side expansion portion 56 when both cylinder blocks 11 and 12 are coupled. A discharge muffler region is defined inside each expansion portion 56, 57. The expansion muffler 46 described above and a resonance muffler chamber 58 that is a second muffler chamber constituting a resonance type muffler, are defined in each discharge muffler region, and are open at the joint surfaces of the expansion portions 56 and 57 that oppose each other. When both cylinder blocks 11 and 12 (expansion portions 56 and 57) are coupled with each other, each muffler 46, 58 is sealed and each muffler 46 and 58 define an integrated space, respectively.

In order to secure a predetermined capacity, the expansion muffler 46 is extended along the outer wall surface 11a, 12a of each cylinder block 11, 12 in its outer peripheral direction. In this way, the protruding length of the expansion portions 56 and 57 is reduced as much as possible. Because the expansion muffler 46 is so formed as to bridge both expansion portions 56 and 57 to secure the capacity, the protruding length of the expansion portions 56 and 57 can be reduced, too.

The expansion muffler 46 and the resonance muffler 58 are partitioned mutually by partitions 59 and 60 that are coupled with each other when both cylinder blocks 11 and 12 are mutually coupled. Each partition wall 59, 60 is formed integrally with each cylinder block 11, 12 when the latter is cast. The resonance muffler 58 has a predetermined capacity and is disposed above the expansion muffler 46 in the vertical direction. The resonance muffler 58 is communicated with the expansion muffler 46 through a communication passage 61 that functions also as a feedback passage. A part of the refrigerant gas passing through the expansion muffler 46 flows into this resonance muffler 58. However, because the resonance muffler 58 has a dead end, it does not constitute a part of the communication passage of the refrigerant gas from the discharge chambers 38 and 39 to the external refrigerant circuit 33.

Figure 3:
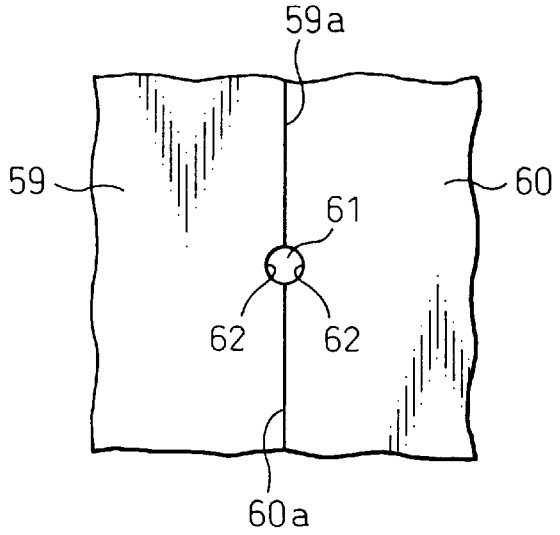
FIG. 3 is a plan view showing, enlarged, the portions in proximity to a communication passage shown in FIG. 1.

The communication passage 61, as shown in FIGS. 1 to 3, comprises grooves 62 that have a semicircular section and are formed at a substantial center of the coupling surfaces 59*a*, 60*a* of both partitions 59 and 60. The communication passage 61 is so formed as to secure a predetermined opening area and a predetermined passage length. The capacity of the resonance muffler 58, the sectional area of opening of the communication passage 61, and its passage length, are set to appropriate values so that a pressure change, that offsets a specific frequency component in the discharge pulsation (periodical pressure change) of the refrigerant gas inside the expansion muffler 46, can be generated when a part of the refrigerant gas flowing inside the expansion muffler 46 flows into the resonance muffler 58. Consequently, the specific frequency components of the discharge pulsation inside the expansion muffler 46 can be damped.

The lubricant that is dispersed in the atomized state also flows into the resonance muffler 58 while being carried by the refrigerant gas. This lubricant adheres to the inner wall surface and condenses into droplets as the refrigerant gas repeatedly impinges against the inner wall surface of the resonance muffler 58. The condensing lubricant is fed back into the expansion muffler 46 through the communication passage 61 described above.

Next, the reducing operation of the discharge pulsation in the double-headed piston type compressor having the construction described above will be explained.

As the clutch mechanism 22 is engaged, the drive force is transmitted from the car engine E to the drive shaft 19. Then, each piston 24 starts a reciprocating motion in an interlocking arrangement with the rotation of the swash plate 28. When each piston 24 starts reciprocating, a series of cycles of suction of the refrigerant gas from each suction chamber 35, 36 into each operation chamber 25, 26, compression inside each operation chamber 25, 26 and discharge to each discharge chamber 38, 39, are started. The refrigerant gases that are discharged to the front side discharge chamber 38 and to the rear side discharge chamber 39 are guided into the expansion muffler 46 through the discharge passage 45 and join together.

In the 10-cylinder type compressor as in this embodiment, the discharge operation is effected ten times per revolution of the swash plate 28. This discharge operation elevates momentarily the pressure inside the expansion muffler 46. Consequently, a discharge pulsation, comprising the $10^{th}$-order frequency component that change ten times per rotation of the swash plate 28, occurs inside the expansion muffler 46.

Figure 4:
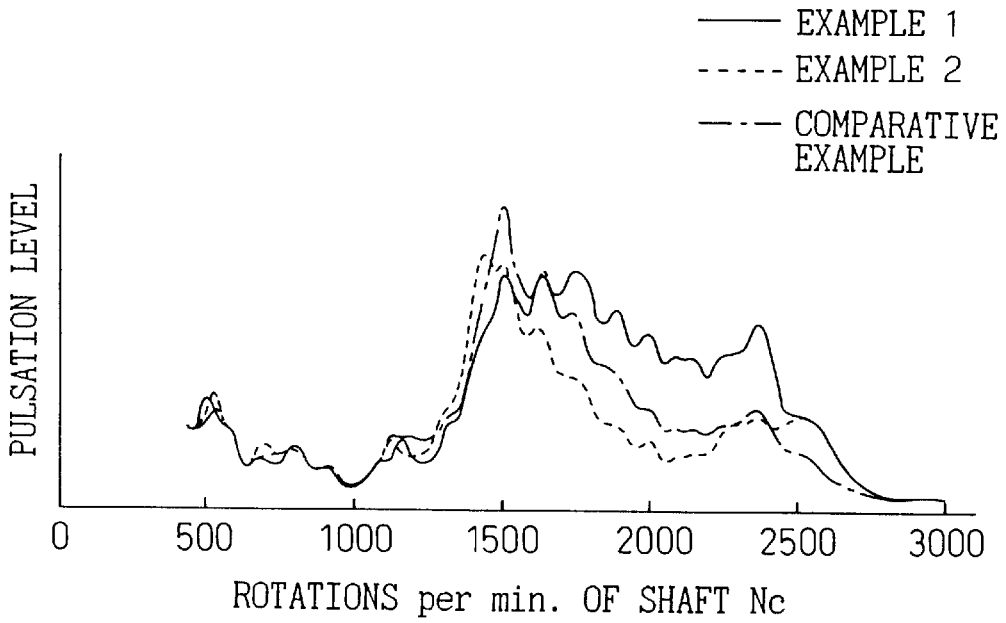
FIG. 4 is an explanatory view of damping of $10^{th}$order frequency component.

FIG. 4 shows an example of the level of the discharge pulsation measured in the piping arrangement between the compressor and the condenser 49 in the external refrigerant circuit 33. In the drawing, Example 1 represents the measurement result in the compressor in which the capacity of the resonance muffler 58 is 12 cc, the open diameter of the communication passage 61 is 3.3 mm and the passage length is 4 mm. Example 2 represents the measurement result in the compressor in which the capacity of the resonance muffler 58 is 12 , the open diameter of the communication passage 61 is 4.8 mm and the passage length is 4 mm. A comparative example represents the measurement result in the compressor that is not equipped with the resonance muffler 58 and the communication passage 61.

FIG. 4 shows that a peak of a large pulsation level exists in around 1,500 rpm, which indicates the numbers of rotation NC of the drive shaft, in the $10^{th}$-order frequency component of the discharge pulsation in the conventional construction, that is, in the 10-cylinder type compressor equipped with only the expansion muffler 46 (Comparative Example). The $10^{th}$-order frequency component near 1,500 rpm has a frequency of about 250 Hz, which is substantially coincident with the intrinsic frequency of the external refrigerant circuit 33. This generates a noise that is different from the engine noise and makes the driver uncomfortable.

In contrast, in the compressors of this embodiment (Examples 1 and 2), peaks exist near 1,500 rpm, but the pulsation level is reduced by about 20% in comparison with the Comparative Example. The pulsation level of the peak at the numbers of rotation other than 1,500 rpm is different between Examples 1 and 2. Therefore, the pulsation level near 1,400 rpm corresponding to the frequency of about 233 Hz, for example, can be reduced effectively by employing the construction of Example 1. The pulsation level near 1,600 to 2,500 rpm corresponding to the frequency of about 266 to 417 Hz can be reduced effectively by employing the construction of Example 2.

Accordingly, this embodiment provides the following effects.

In the compressor according to this embodiment, the expansion muffler 46 and the resonance muffler 58 defined by the partition 59, 60 are disposed inside the expansion portion 56, 57 of the cylinder block 11, 12. The expansion muffler 46 constitutes a part of the flow passage of the refrigerant gas from the discharge chamber 38, 39 to the external refrigerant circuit 33. The resonance muffler 58 is communicated with the expansion muffler 46 through the communication passage 61 while it is independent of the flow passage. The lubricant condensed inside the resonance muffler 58 is fed back into the expansion muffler 46 through the communication passage 61.

Therefore, the lubricant condensed in the resonance muffler 58 does not stay in the resonance muffler 58 and the capacity of the resonance muffler 58 can be kept constant. In consequence, the pressure change that offsets the components of the intended frequency range in the $10^{th}$-order frequency component of the discharge pulsation can be generated stably, and the components in the intended frequency range in the discharge pulsation can be damped stably.

Moreover, the communication passage 61 plays the role of feeding back the lubricant condensed in the resonance muffler 58 into the expansion muffler 46. Therefore, feedback means need not be disposed separately from the communication passage 61, and the construction can be simplified.

In the compressor according to this embodiment, the capacity of the resonance muffler 58, the open sectional area of the communication passage 61 and its passage length, are set so that the frequency of the pressure change generated inside the resonance muffler 58 coincides with the resonance frequency of the expansion muffler 46 and has the opposite phase to the discharge pulsation of the expansion muffler 58.

Consequently, the pressure change that offsets the components of the intended frequency range in the pressure pulsation can be controlled not only by the capacity of the resonance muffler 58 but also by the combination with the set values of the open sectional area of the communication passage 61 and its passage length. Therefore, freedom of design in the expansion muffler 46 and the resonance muffler 58 can be improved, and the sizes of both mufflers 46 and 58 can be reduced.

The frequency of the pressure change occurring in the resonance muffler 58 can be changed by changing the combination of the set values of the capacity of the resonance muffler 58, the open sectional area of the communication passage 61 and its passage length. Therefore, countermeasures can be taken easily against various frequency components in the discharge pulsation.

In the compressor of this embodiment, the resonance muffler 58 is positioned above the expansion muffler 46 in the gravitational direction (vertical direction).

For this reason, the lubricant condensed inside the resonance muffler 58 can be fed automatically by its own weight into the expansion muffler 46 through the communication passage 61. In other words, the lubricant condensed inside the resonance muffler 58 can be automatically fed back into the expansion muffler 46 by a simple construction.

In the compressor of this embodiment, the partitions 59 and 60 that define the expansion muffler 46 and the resonance muffler 58 are integrally formed with the front side cylinder block 11 and the rear side cylinder block 12, respectively, that are so disposed as to oppose each other. The expansion muffler 46 and the resonance muffler 58 are formed when both cylinder blocks 11 and 12 are coupled. The communication passage 61 that communicates both mufflers 46 and 58 comprises the grooves 62 formed on the joint surfaces 59*a* and 60*a* of both partitions 59 and 60.

Therefore, when both cylinder blocks 11 and 12 are coupled with each other, the expansion muffler 46 and the resonance muffler 58 can be automatically defined. Also, the communication passage 61 can be defined automatically in this case. Therefore, the increase in working steps is not necessary for forming both mufflers 46 and 58 and the communication passage 61.

When the partitions 59 and 60 for defining both mufflers 46 and 58 are formed integrally with the cylinder block 11 and 12, other components separate from the cylinder blocks 11 and 12 are not necessary. In consequence, the number of necessary components does not increase.

[Second Embodiment]

The second embodiment of the present invention will be explained primarily with reference to differences from the first embodiment.

Figure 5:
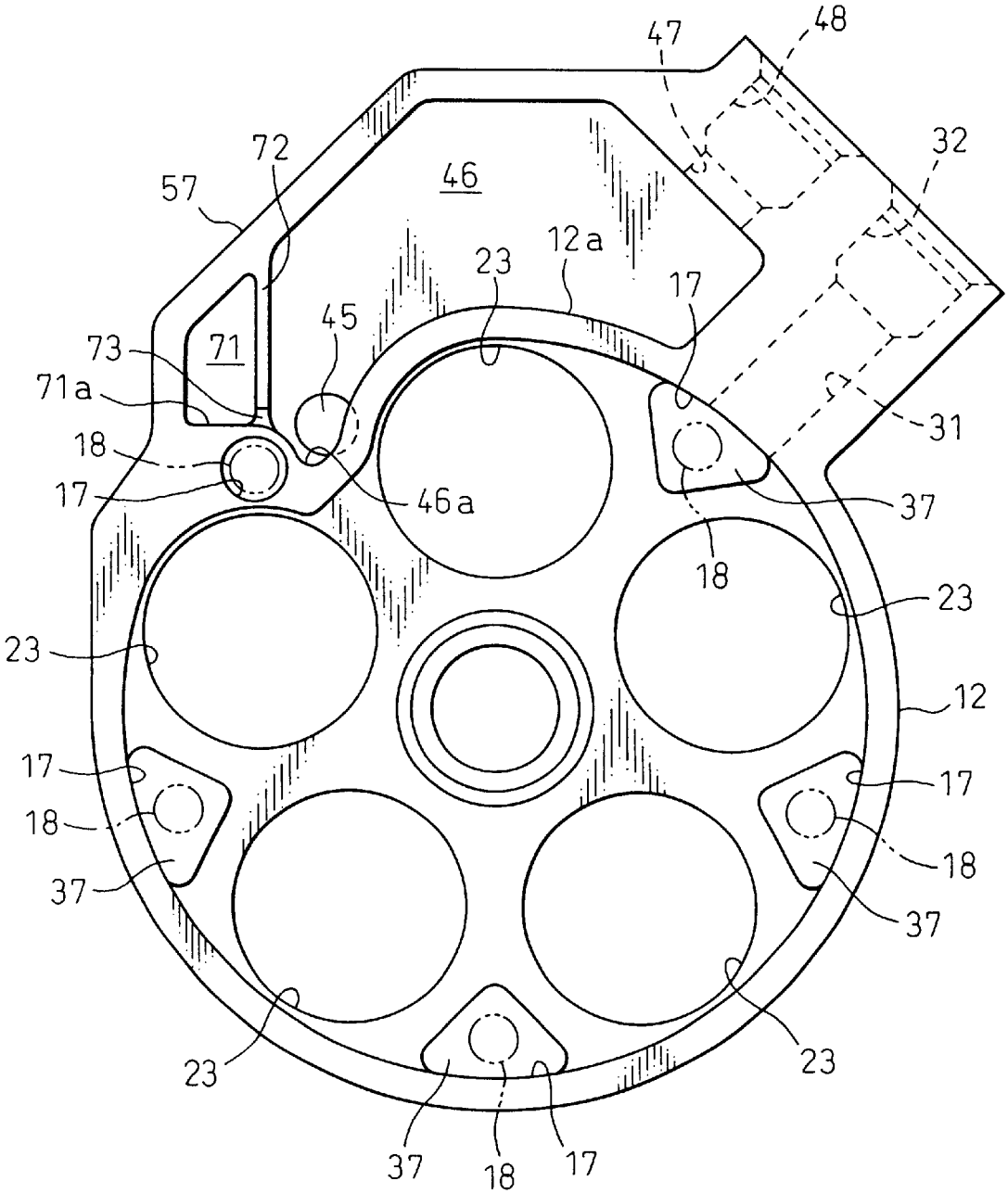
FIG. 5 is a side view of a cylinder block on the rear side in the second embodiment of the present invention when it is viewed from the front side.

In this second embodiment, the resonance muffler 71 that constitutes the second muffler chamber is disposed on the side of the expansion muffler 46 in the gravitational direction (vertical direction) as shown in FIG. 5. The inner bottom surface 71*a* of this resonance muffler 71 is situated at a position higher than the inner bottom surface 46*a* of the expansion muffler 46 in the gravitational direction (vertical direction). The partition 72 for defining both mufflers 46 and 71 is fabricated in metal sheet separate from each cylinder block 12(11) and is fitted to each cylinder block 12(11) in the gravitational direction (vertical direction). A communication hole 73, as a communication passage, which functions also as feedback means is formed in the partition 72 at the position corresponding to the inner bottom surface 71*a* of the resonance muffler 71. (Incidentally, only the cylinder block 12 on the rear side is shown in FIG. 4.)

Therefore, this embodiment provides the following effects in addition to the effects brought forth by the first embodiment.

In the compressor according to the second embodiment, the inner bottom surface 71*a* of the resonance muffler 71 is disposed at the position higher than the position of the inner bottom surface 46*a* of the expansion muffler 46 in the gravitational direction (vertical direction). The communication hole 73 is formed in the partition 72 at the position corresponding to the inner bottom surface 71*a*.

Therefore, the lubricant condensed inside the resonance muffler 71 reaches, by its own weight, the inner bottom surface 71*a* of the resonance muffler 71 and is further fed back automatically to the expansion muffler 46 through the communication hole 73. Therefore, the lubricant condensed in the resonance muffler 71 can be automatically fed back to the expansion muffler 46 by a simple construction.

In the compressor of this second embodiment, the partition 72 for partitioning the expansion muffler 46 and the resonance muffler 71 comprises a member that is separate from each cylinder block 11, 12.

Therefore, the frequency of the pressure change occurring in the resonance muffler 71 can be easily changed by selecting and fitting the partition 72 having a communication hole 73 having a different open sectional area and/or a passage length. In consequence, the compressor can easily cope with various frequency components in the discharge pulsation.

Incidentally, each of the foregoing embodiments may be modified in the following way.

In the first embodiment, the groove 62 is formed in the joint surface 59*a*, 60*a* of each partition 59, 60 to form the communication passage 61. However, the groove 62 may be formed in only either one of the joint surfaces 59*a* and 60*a*.

In the first embodiment, the groove 62 on the joint surface 59*a*, 60*a* of each partition 59, 60 is shaped into the semicircular sectional shape, but it may be shaped into an elliptic sectional shape or a triangular sectional shape, for example.

In the first embodiment, the communication passage 61 is formed on the joint surface 59*a*, 60*a* of each partition 59, 60, but it may be formed at a position spaced apart from the joint surface 59*a*, 60*a* of each partition 59, 60.

In each of the foregoing embodiments, the expansion muffler 46 and the resonance muffler 58, 71 are formed in such a manner as to bridge a pair of cylinder blocks 11 and 12, but they may be formed in either one of the cylinder blocks 11 and 12.

Each of the foregoing embodiments represents the application of the present invention to the double-headed piston type swash plate compressor used for the car air conditioner. However, the present invention can be applied likewise to the discharge pulsation damping apparatus of a wave cam type compressor, a wobble type compressor, a scroll type compressor, a vane type compressor or a single-headed piston type compressor. The present invention may be further applied to the discharge pulsation damping apparatus of a compressor used for a compressed air feeding apparatus. In this case, the liquid condensed inside the resonance muffler 58, 71 includes water, for example, besides the lubricant.

While the present invention has been described with reference to specific embodiments chosen for purposes of illustration, it should be apparent that numerous modifications could be made thereto by those skilled in the art without departing from the basic concept and scope of the invention.

What is claimed is:

1. A discharge pulsation damping apparatus of a compressor including a housing therein, a compression mechanism for sucking a compressive fluid from outside, compressing said compressive fluid and discharging it to a discharge chamber defined inside said housing, a flow passage for guiding said compressive fluid inside said discharge chamber to the outside of said compressor, a discharge muffler region defined at an intermediate part of said flow passage inside said housing, a discharge pulsation damping apparatus of said compressor characterized in that a partition is disposed inside said discharge muffler region in such a manner as to divide said discharge muffler region into a first muffler chamber constituting a part of said flow passage and a second muffler chamber communicated with said first muffler chamber through a communication passage and independent of said flow passage, and feedback means is disposed for feeding back a fluid supplied into said second muffler chamber, while being carried by said compressive fluid and condensed inside said second muffler chamber, into said first muffler chamber.

2. A discharge pulsation damping apparatus of a compressor according to claim 1, wherein the capacity of said second muffler chamber, the open sectional area of said communication passage and the passage length of said communication passage are set to values such that the pulsation occurring in said second muffler chamber coincides with a resonance frequency of said first muffler chamber and has an opposite phase to that of a pulsation inside said first muffler chamber.

3. A discharge pulsation damping apparatus according to claim 2, wherein said housing comprises a plurality of housing constituent members, said partition is formed integrally with a pair of said housing constituent members so disposed as to oppose each other, each of said muffler chambers is defined by joining mutually the pair of said housing constituent members, and said communication passage comprises a groove formed in at least one of the joint surfaces of said partitions in the pair of said housing constituent members.

4. A discharge pulsation damping apparatus of a compressor according to claim 2, wherein said communication passage functions also as said feedback means.

5. A discharge pulsation damping apparatus according to claim 4, wherein said second muffler chamber is disposed at an upper position in a gravitational direction (vertical direction) and said first muffler chamber is disposed at a lower position in the gravitational direction (vertical direction).

6. A discharge pulsation damping apparatus of a compressor according to claim 4, wherein the inner bottom surface of said second muffler chamber is so formed as to be positioned higher than the inner bottom surface of said first muffler chamber in a gravitational direction (vertical direction), and said communication hole is formed at a position corresponding to the position of the inner bottom surface of said second muffler chamber in said partition.

7. A discharge pulsation damping apparatus of a compressor according to claim 1, wherein said communication passage functions also as said feedback means.

8. A discharge pulsation damping apparatus of a compressor according to claim 7, wherein said second muffler chamber is disposed at an upper position in a gravitational direction (vertical direction), and said first muffler chamber is disposed at a lower position in the gravitational direction (vertical direction).

9. A discharge pulsation damping apparatus of a compressor according to claim 7, wherein the inner bottom surface of said second muffler chamber is so formed as to be positioned higher than the inner bottom surface of said first muffler chamber in a gravitational direction (vertical direction), and said communication hole is formed at a position corresponding to the position of the inner bottom surface of said second muffler chamber in said partition.

10. A discharge pulsation damping apparatus according to claim 1, wherein said housing comprises a plurality of housing constituent members, said partition is formed integrally with a pair of said housing constituent members so disposed as to oppose each other, each of said muffler chambers is defined by joining mutually the pair of said housing constituent members, and said communication passage comprises a groove formed in at least one of the joint surfaces of said partitions in the pair of said housing constituent members.

* * * * *